US007226141B2

(12) United States Patent
Asano et al.

(10) Patent No.: US 7,226,141 B2
(45) Date of Patent: Jun. 5, 2007

(54) INKJET RECORDING APPARATUS AND CONTROL METHOD OF INKJET RECORDING APPARATUS

(75) Inventors: Kazuo Asano, Hino (JP); Akiko Kitami, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 314 days.

(21) Appl. No.: 11/042,723

(22) Filed: Jan. 24, 2005

(65) Prior Publication Data

US 2005/0168510 A1 Aug. 4, 2005

(30) Foreign Application Priority Data

Jan. 30, 2004 (JP) ..... 2004-023647

(51) Int. Cl.
*B41J 2/01* (2006.01)

(52) U.S. Cl. ..... 347/10; 347/17

(58) Field of Classification Search ..... 347/10, 347/11, 17, 14, 57
See application file for complete search history.

(56) References Cited

U.S. PATENT DOCUMENTS 6,193,344 B1 * 2/2001 Otsuka et al. ..... 347/11
2002/0041300 A1 * 4/2002 Iwasaki et al. ..... 347/19

FOREIGN PATENT DOCUMENTS

JP 05-155026 A 6/1993

* cited by examiner

*Primary Examiner*—Lamson Nguyen
(74) *Attorney, Agent, or Firm*—Frishauf, Holtz, Goodman & Chick, P.C.

(57) ABSTRACT

An inkjet recording apparatus having a head that ejects ink droplets, a temperature detector that detects temperatures in the vicinity of the head, and a drive waveform controller that generates a drive waveform driving the head, wherein the drive waveform controller changes, based on temperature information coming from the temperature detector, the amplitude as temperature changes, according to the expression V=EXP(A/T+B) wherein V represents an amplitude of the drive waveform, T represents the temperature and A and B represent a constant.

15 Claims, 11 Drawing Sheets

FIG. 5
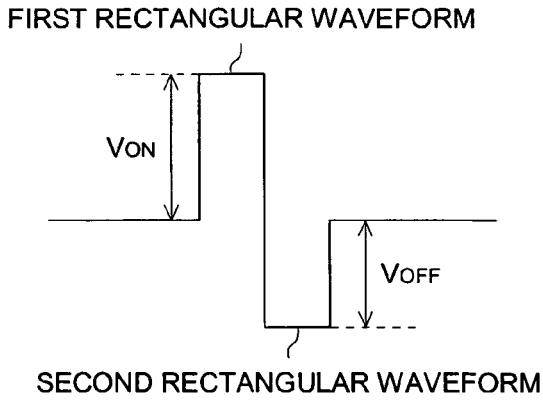
FIG. 6 ( a )
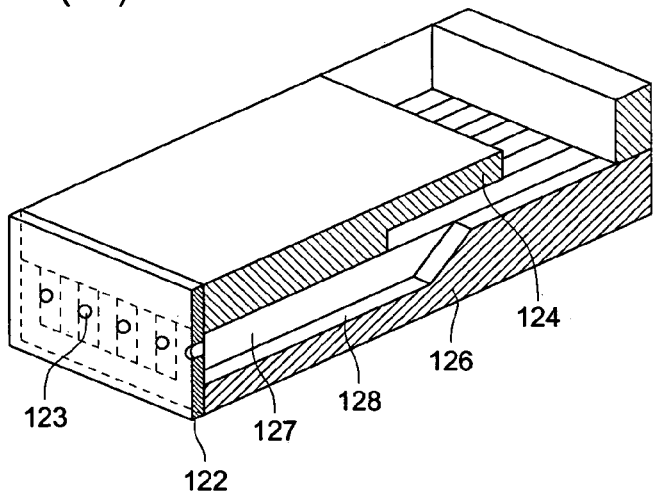
FIG. 6 ( b )
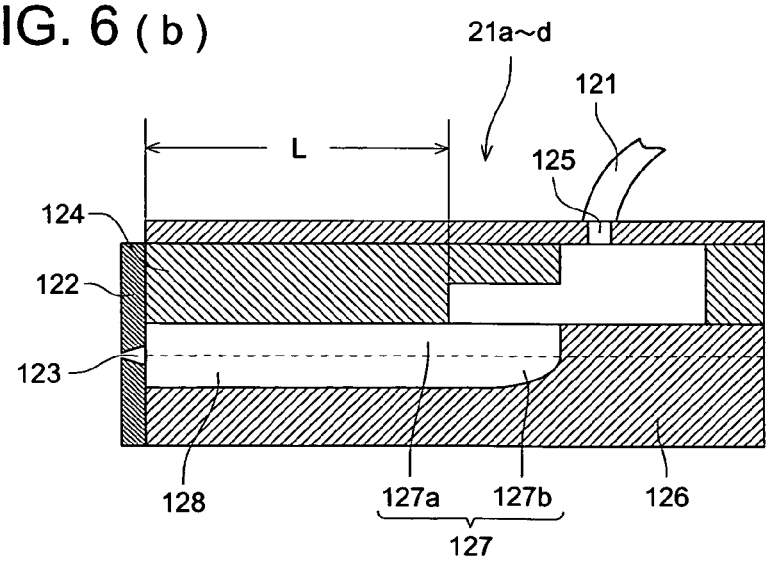

FIG. 8 ( a )
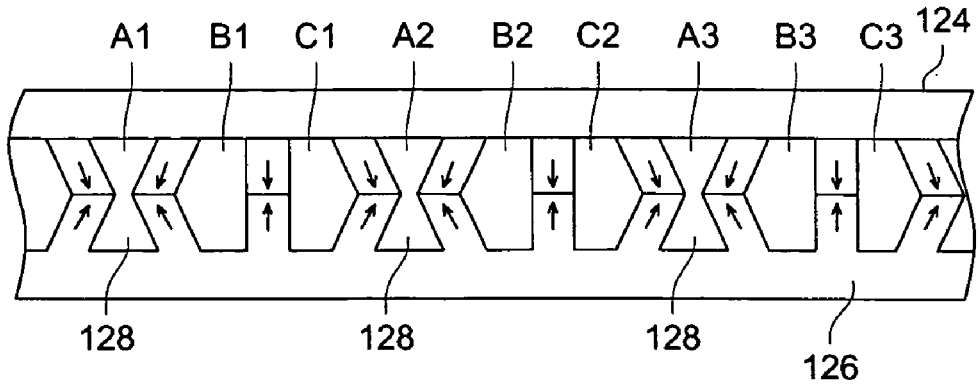
FIG. 8 ( b )
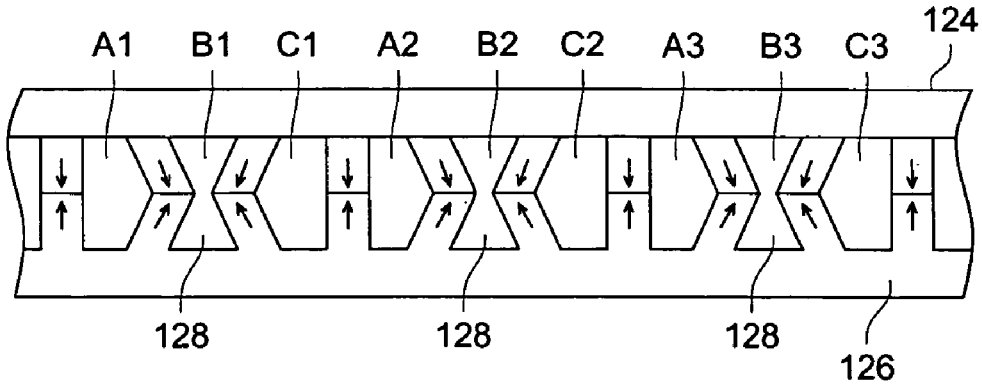
FIG. 8 ( c )
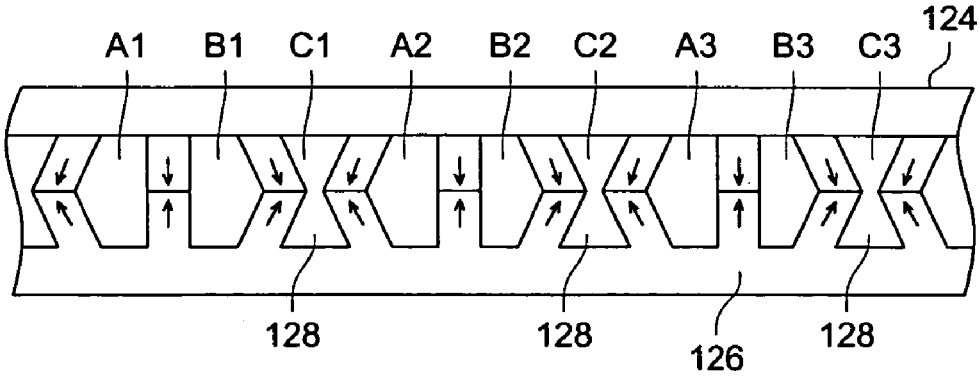

INKJET RECORDING APPARATUS AND CONTROL METHOD OF INKJET RECORDING APPARATUS

FIELD OF THE INVENTION

The present invention relates to an inkjet recording apparatus that ejects ink droplets repeatedly and forms an image on a recording medium, and to a control method of the inkjet recording apparatus.

BACKGROUND OF THE INVENTION

In recent years, there is a demand for image quality with high resolution and high-definition comparable to photographs, even for image forming by the use of an inkjet recording apparatus. Under such condition, droplets of ink ejected on a recording medium are strictly controlled in terms of a quantity and an ejecting speed, for quality improvement.

On the other hand, fluctuations of temperatures in operations of the inkjet recording apparatus, especially, fluctuations of temperatures in a head portion that ejects ink are unavoidable, and this temperature changes make it difficult to control ejected droplets strictly.

Therefore, temperature changes of ink are detected, and based on information of the detection, droplets are strictly controlled. In this case, an ejecting speed of a droplet ejected from the head varies. Thus, in compensation for these, an amplitude of a drive waveform in the case of driving the head electrically is corrected. In this correction, an amplitude change for the temperature change is determined by the linear function (e.g., see Patent Document 1).

(Patent Document 1) TOKKAIHEI No. 5-155026 (page 3, FIG. 5)

However, in the aforementioned technical field background technology, when ink viscosity is high, there is sometimes an occasion wherein correction by means of an amplitude of a drive waveform is not conducted properly. That is, an error in an ejecting speed of droplets depending on viscosity is large in the case of approximation by a linear function, because temperature changes do not cause ink viscosity to undergo a linear change approximated by a linear function.

Especially, in ink having high viscosity, a non-linear change of viscosity for temperature changes is great, and an error from linear approximation of viscosity for big changes of temperature is large. Due to this, correction of an amplitude of drive waveform wherein a linear change of viscosity is assumed is not conducted properly, thus, an ejecting speed or a volume of droplets ejected from the head is varied by temperatures, resulting in deterioration of image quality.

From the background stated above, a matter of importance is how to realize an inkjet recording apparatus wherein an ejecting speed or a volume of droplets ejected from the head is not affected by temperature changes, even when ink viscosity is great.

SUMMARY OF THE INVENTION

The invention is one which has been achieved to solve the problems in the background technology mentioned above, and its object is to provide an inkjet recording apparatus wherein an ejecting speed or a volume of droplets ejected from the head is not affected by temperature changes, even when ink viscosity is high.

An embodiment of the inkjet recording apparatus for solving the aforesaid problems and attaining the object is composed of a head that ejects ink droplets, a temperature detector that detects temperatures in the vicinity of the head, and a drive waveform controller that generates a drive waveform driving the head, wherein the drive waveform controller changes, based on temperature information coming from the temperature detector, the amplitude as temperature changes, following the expression V=EXP(A/T+B) wherein V represents an amplitude of the drive waveform, T represents the temperature and A and B represent a constant.

Figure 3:
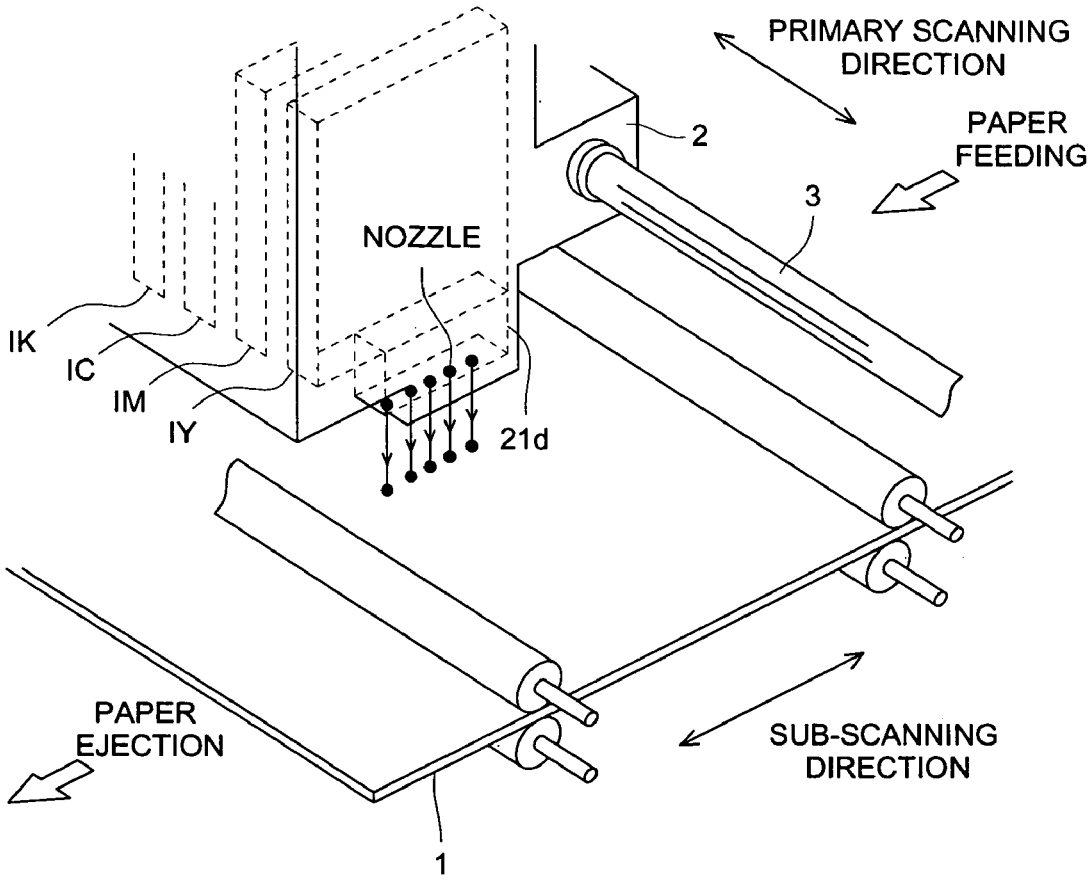
Figure 3:
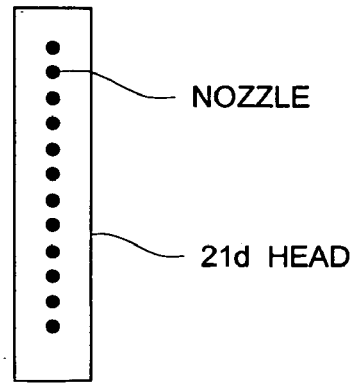

Each of FIG. 3(*a*) and FIG. 3(*b*) is a diagram showing the structure of a head of an inkjet recording apparatus.

Figure 4:
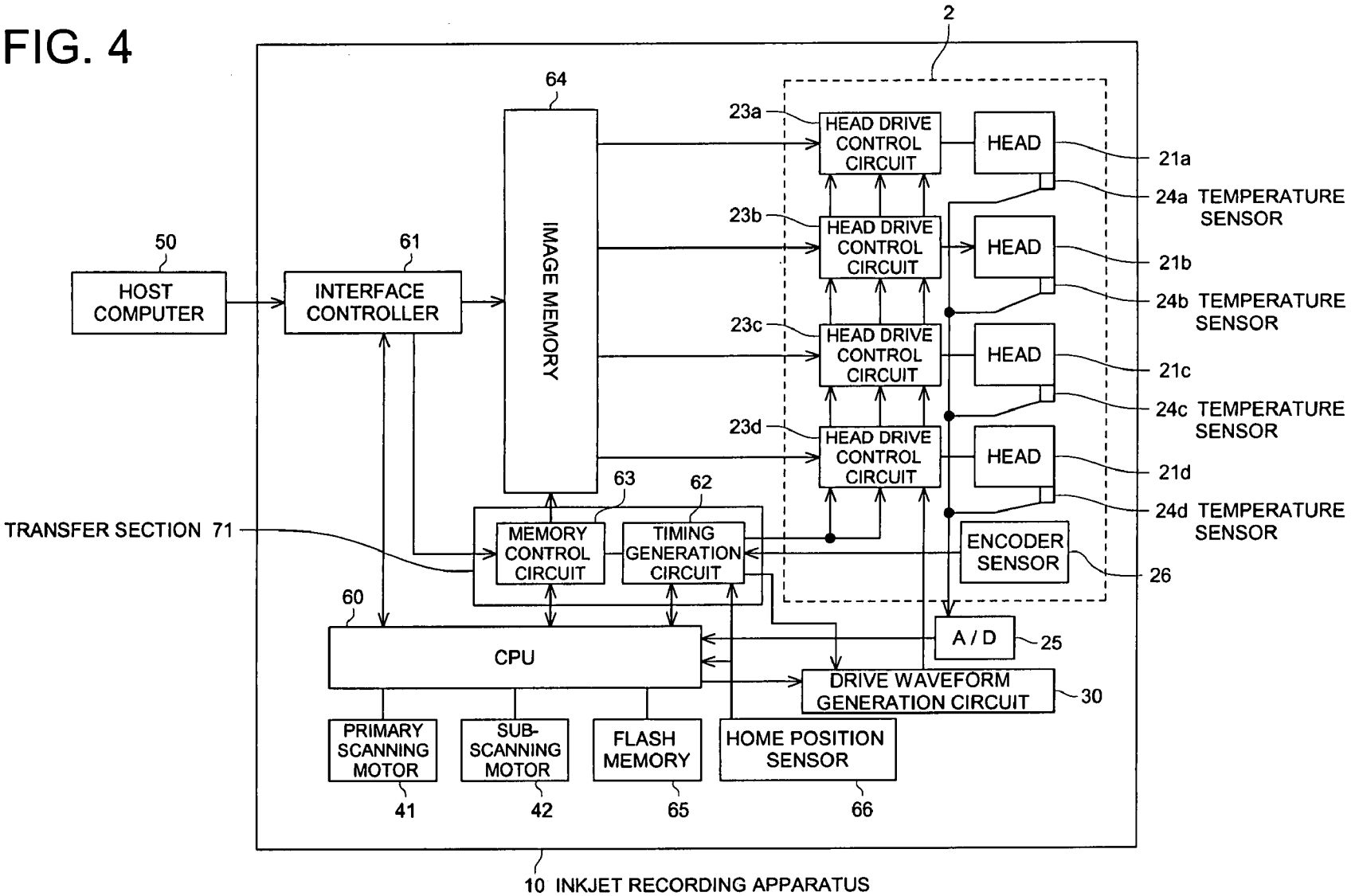

FIG. 4 is a diagram showing the electrical and entire structure of an inkjet recording apparatus.

FIG. 5 is a diagram showing a drive waveform of a head in the embodiment.

Each of FIG. 6(*a*) and FIG. 6(*b*) is a diagram showing the mechanical structure of a head in the embodiment.

Figure 7:
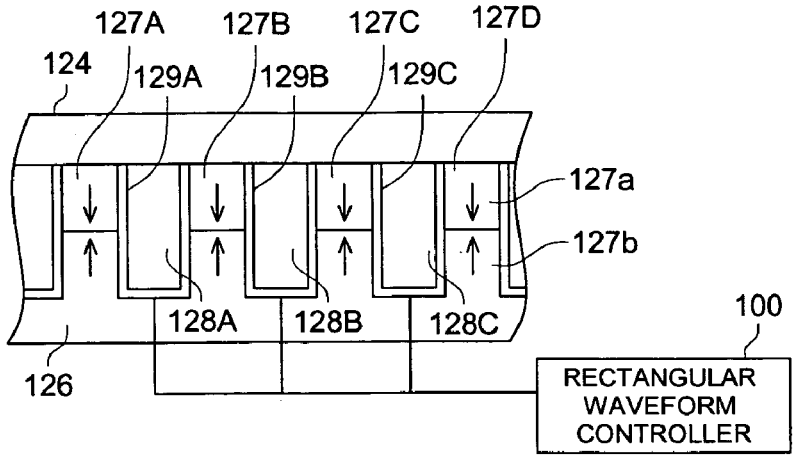
Figure 7:
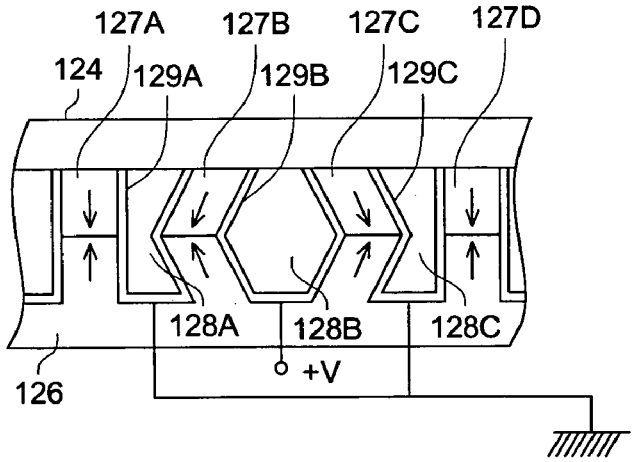
Figure 7:
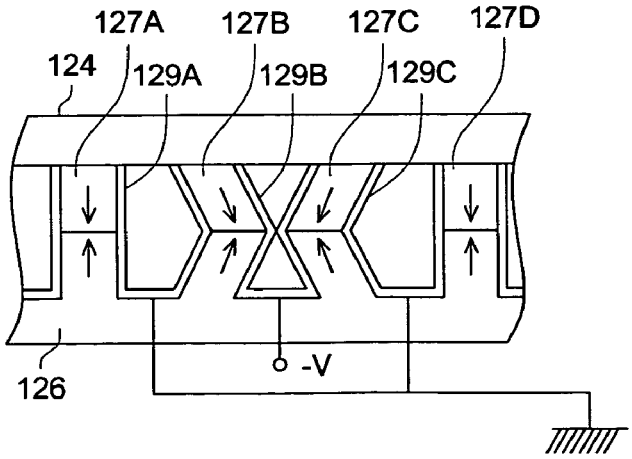

Each of FIG. 7(*a*), FIG. 7(*b*) and FIG. 7(*c*) is a diagram showing ink ejecting operations of a head in the embodiment.

Each of FIG. 8(*a*), FIG. 8(*b*) and FIG. 8(*c*) is a diagram showing three-cycle ink ejecting operations for a head in the embodiment.

Figure 9:
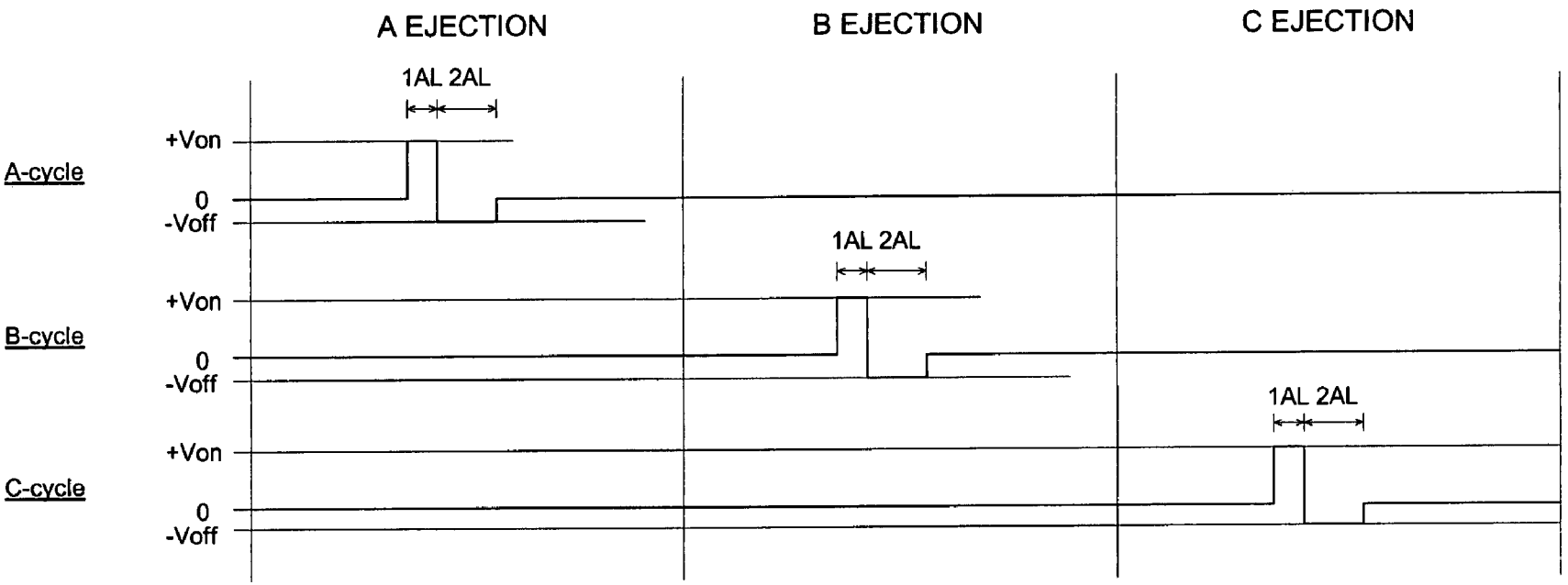

FIG. 9 is a diagram showing a timing chart of a drive waveform in the case of three-cycle ink ejecting operations for a head in the embodiment.

Figure 10:
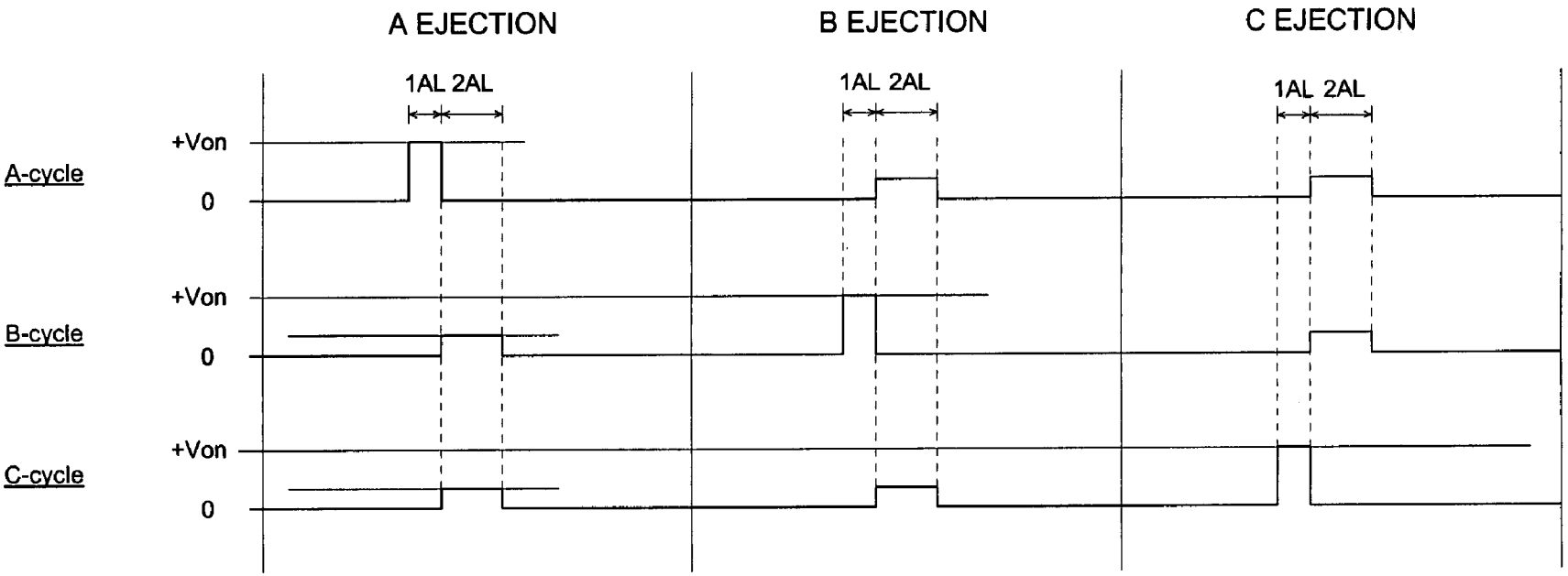

FIG. 10 is a diagram showing a timing chart for conducting three-cycle ink ejecting operations for a head in the embodiment by using only a drive waveform of positive voltage.

Figure 11:
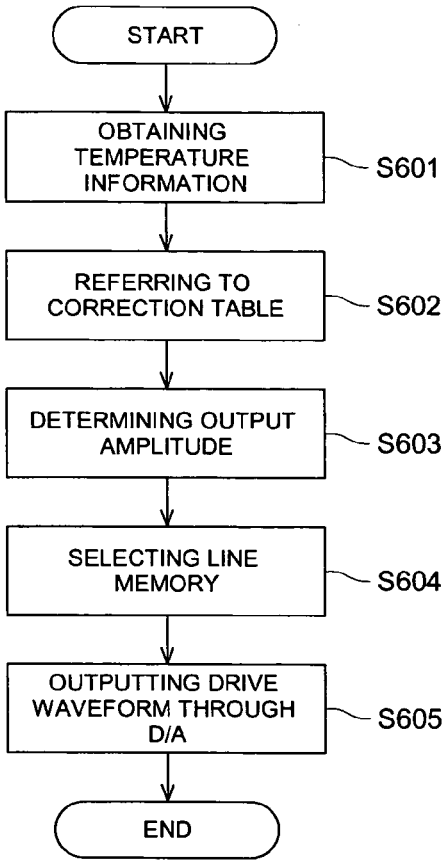

FIG. 11 is a flow chart showing operations to conduct temperature correction for an amplitude of drive waveform in the embodiment.

Figure 12:
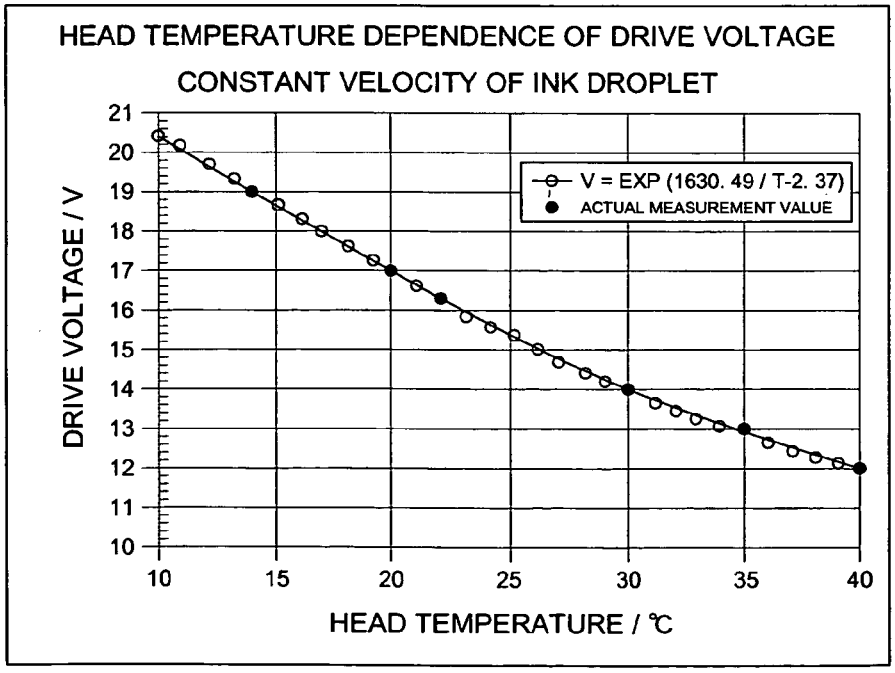

FIG. 12 is a diagram showing an example of a correction table in the embodiment.

Figure 13:
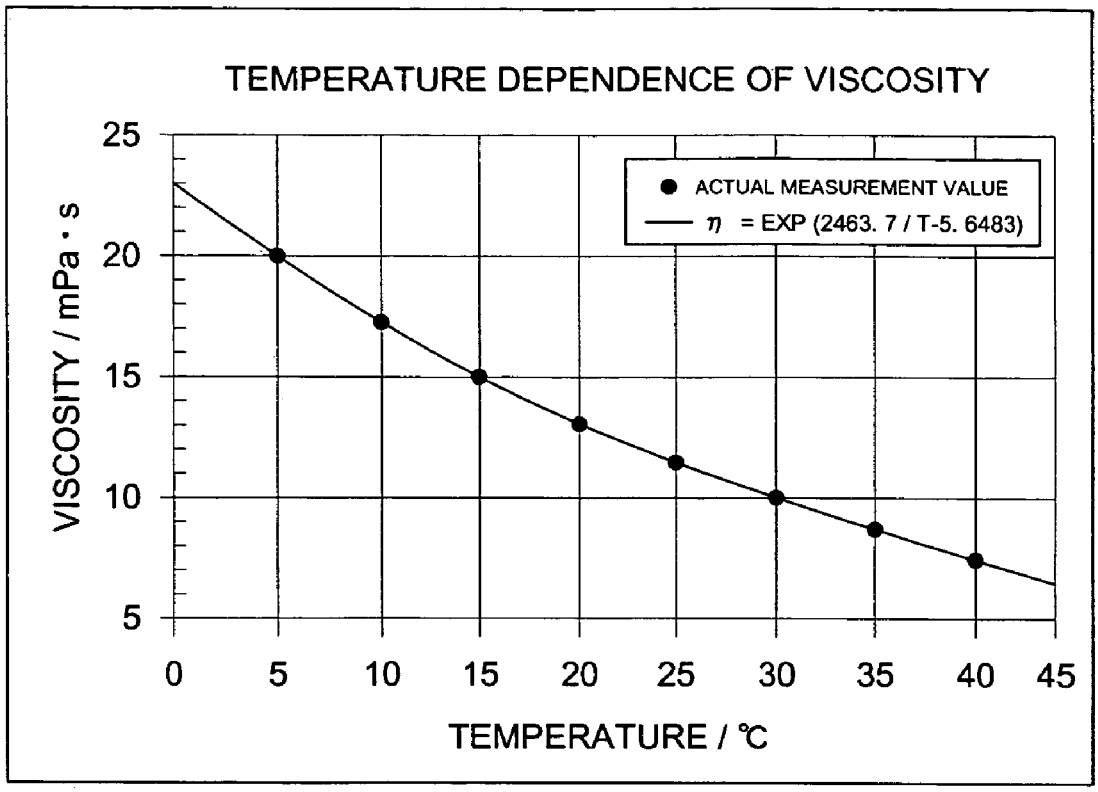

FIG. 13 is a diagram exemplifying temperature dependency of viscosity shown by ink.

DETAILED DESCRIPTION OF THE PREFERRED EMBODIMENT

A preferred embodiment to practice an inkjet recording apparatus related to the invention will be explained as follows, referring to the drawings attached. Incidentally, the invention is not limited to the embodiment.

Figure 2:
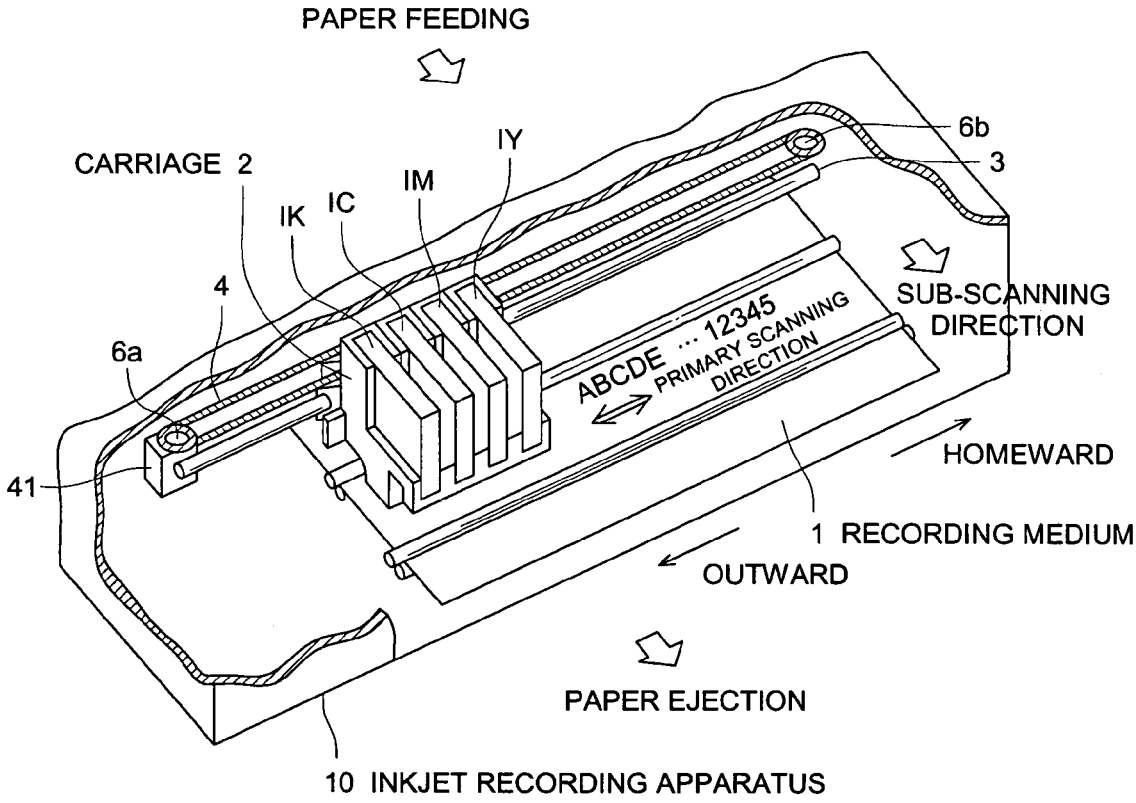
FIG. 2 is a diagram showing the mechanical and entire structure of an inkjet recording apparatus.

First, FIG. 2 shows the mechanical structure of inkjet recording apparatus 10 relating to the present embodiment. FIG. 2 is a diagram showing the mechanical structure of inkjet recording apparatus 10, focusing on carriage 2. The inkjet recording apparatus 10 includes carriage 2, supporting bar 3, drive belt 4, primary scanning motor 41, rollers 6*a* and 6*b* and recording medium 1. The recording medium 1 includes a recording sheet of paper on which image information is recorded, and it is moved in the sub-scanning direction that is a transporting direction. The supporting bar 3 is a metal bar which is in the primary scanning direction that is perpendicular to the sub-scanning direction, and the carriage 2 is supported by the supporting bar to be movable in the primary scanning direction. The carriage 2 is fixed on drive belt 4 which wounds itself round the rollers 6*a* and 6*b* to be driven by primary scanning motor 41 to move. Owing to this, the carriage 2 travels on the support bar 3 in the primary scanning direction to print images on the recording medium 1.

On the carriage 2, there are mounted detachably cartridges 1K, 1C, 1M and 1Y containing respectively ink black K, ink cyan C, ink magenta M and ink yellow Y. On the lower end portion of the carriage 2, there are arranged heads respectively for unillustrated 1K, 1C, 1M and 1Y, and ink is ejected from each of nozzles representing a plurality of ink ejecting outlets of each head on recording medium 1 existing in the lower end portion of the carriage 2.

Each of FIG. 3(*a*) and FIG. 3(*b*) shows an enlarged diagram of lower end portions of cartridges 1K, 1C, 1M, 1Y and head 21*d* connected to the cartridge 1Y. FIG. 3(*a*) shows head 21*d* existing at the lower end portion of the cartridge 1Y mounted on the carriage 2. In this case, the head 21*d* has plural nozzles which line up in the sub-scanning direction as shown in FIG. 3(*b*). From this nozzle, there is ejected ink contained in cartridge 1Y shown in FIG. 3(*a*) at the same time, and ink droplets which line up in one row in the sub-scanning direction on recording medium 1 are recorded. Incidentally, the cartridges 1K, 1C, 1M and heads 21*a*–21*c* which are not illustrated and correspond to the cartridges have the structure that is exactly the same as the aforesaid one, and are arranged in the primary scanning direction of the carriage 2.

FIG. 4 is a block diagram showing the electrical structure of inkjet recording apparatus 10. The inkjet recording apparatus 10 includes interface controller 61, image memory 64, transfer section 71, carriage 2, CPU 60, primary scanning motor 41, sub-scanning motor 42, memory 65, drive waveform generation circuit 30, A/D converter 25, and home position sensor 66. Incidentally, the inkjet recording apparatus 10 is connected to host computer 50 to acquire image information to be recorded.

The interface controller 61 serves as an input section to take in image information from the host computer 50 connected through communication lines.

The image memory 64 temporarily stores image information obtained through interface controller 61. This image information forms a part of original image information of the host computer 50, and it includes necessary and minimum image information in the case of printing images by the carriage 2 which will be explained later. Incidentally, this image information forms image information in a bitmap form for each color of black, cyan, magenta and yellow.

The carriage 2 prints image information stored in the image memory 64 on recording medium 1. The carriage 2 in this case includes therein heads 21*a*–21*d*, temperature sensors 24*a*–24*d*, head drive control circuits 23*a*–23*d* and encoder sensor 26. A group of the heads 21*a*–21*d* is composed of 21*a* for ejecting black ink (K), 21*b* for ejecting cyan ink (C), 21*c* for ejecting magenta ink (M) and 21*d* for ejecting yellow ink (Y), all of which are placed side by side in the primary scanning direction as shown in FIG. 3(*a*). Each head has ink-ejecting nozzles in quantity of, for example, 512 arranged in a line, in the sub-scanning direction, as shown in FIG. 3(*b*).

The heads 21*a*–21*d* eject each ink respectively in cartridges 1K, 1C, 1M and 1Y on recording medium 1 as ink droplets. A piezo-head of a shear-mode type, for example, is used as the heads 21*a*–21*d*. In the piezo-head of a shear-mode type, when a drive waveform rises to positive voltage from ground voltage, a channel side wall is deformed in the direction to increase a volume of an ink channel, while when the drive waveform changes to negative voltage, the channel side wall is deformed in the direction to decrease the volume of the ink channel. Incidentally these structure and operations of the foregoing head will be explained in detail, later.

Further, on the heads 21*a*–21*d*, there are mounted temperature sensors 24*a*–24*d* which constitute a temperature detecting section. The temperature sensors 24*a*–24*d* include the temperature detecting elements, for example, thermistor etc., and arranged in the vicinity of the heads 21*a*–21*d*. The temperature sensors 24*a*–24*d* measure temperatures in the vicinity of the heads 21*a*–21*d*, and results thereof are converted by A/D converter 25 into digital signals from analog ones, and then, temperature information is transferred to CPU 60 which will be explained later.

In this case, the expression "in the vicinity of the heads" stated above means a position where the temperatures reflecting temperatures in ink channels of heads 21*a*–21*d* can be detected, and it is preferable that the temperature sensors 24*a*–24*d* are provided to be in contact with surfaces of members forming ink channels of the heads 21*a*–21*d*, or of members which are in contact with the aforesaid members forming ink channels of the heads 21*a*–21*d*. For example, in the example of a recording head of a shear-mode type shown in FIG. 6 described later, temperature sensors 24*a*–24*d* installed on a surface of cover plate 124 or of base board 129 are preferable.

Each of head drive control circuits 23*a*–23*d* controls timing of ejecting a droplet of ink for each of heads a–d, based on image information from image memory 64. In the head drive control circuits 23*a*–23*d*, a driver to drive a piezo-head is present in each channel, and it drives the piezo-head based on a drive waveform coming from drive waveform generation circuit 30 which will be explained later.

Encoder sensor 26 is present on the carriage 2 and reads black marks, for example, which are marked at prescribed intervals in the primary scanning direction of supporting bar 3. Hereby, a position of the carriage 2 in the primary scanning direction is precisely captured, and thereby, timing of ejecting ink is made to be appropriate.

Home position sensor 66 is a sensor to detect whether the carriage 2 is at the home position or not. The home position in this case is, for example, at the end portion in the primary scanning direction within a movable range of the carriage 2 on inkjet recording apparatus 10 shown in FIG. 2, representing, for example, a right end in FIG. 2. Incidentally, an accurate position of the carriage 2 in the primary scanning direction can be calculated by using output of the encoder sensor 26 with this home position as a starting position.

Transfer section 71 transfers from image memory 64 to each of head drive control circuits 23*a*–23*d* a partial image information to be recorded by a single ink ejection from plural nozzles of each head. The transfer section 71 includes timing generation circuit 62 and memory control circuit 63. The timing generation circuit 62 obtains an accurate position of the carriage 2 based on the output coming from home position sensor 66 and from encoder sensor 26, while the memory control circuit 63 obtains, from this position information, an address of the partial image information required for each head. Then, the memory control circuit 63 conducts reading data from image memory 64 and transferring the data to head drive control circuits 23*a*–23*d*, by using the address of the partial image information.

Primary scanning motor 41 is a motor to move the carriage 2 in the primary scanning direction shown in FIG.

2. Further, sub-scanning motor 42 is a motor to send recording medium 1 in the sub-scanning direction.

Memory 65 is a nonvolatile memory in which a correction table showing relationships between temperatures and amplitudes of drive waveforms described later is stored.

CPU 60 serves as a controller that controls inkjet recording apparatus 10, and controls conveyance of recording medium 1, movement of the carriage 2 and ejection of ink droplets from heads 21*a*–21*d*, and thereby to form targeted image information on recording medium 1.

Drive waveform generation circuit 30 generates drive waveforms, which drive heads 21*a*–21*d*, and eject ink droplets. The drive waveform synchronizes with latch signals of timing generation circuit 62 which latch image information data, and it is generated for each latch signal.

Figure 1:
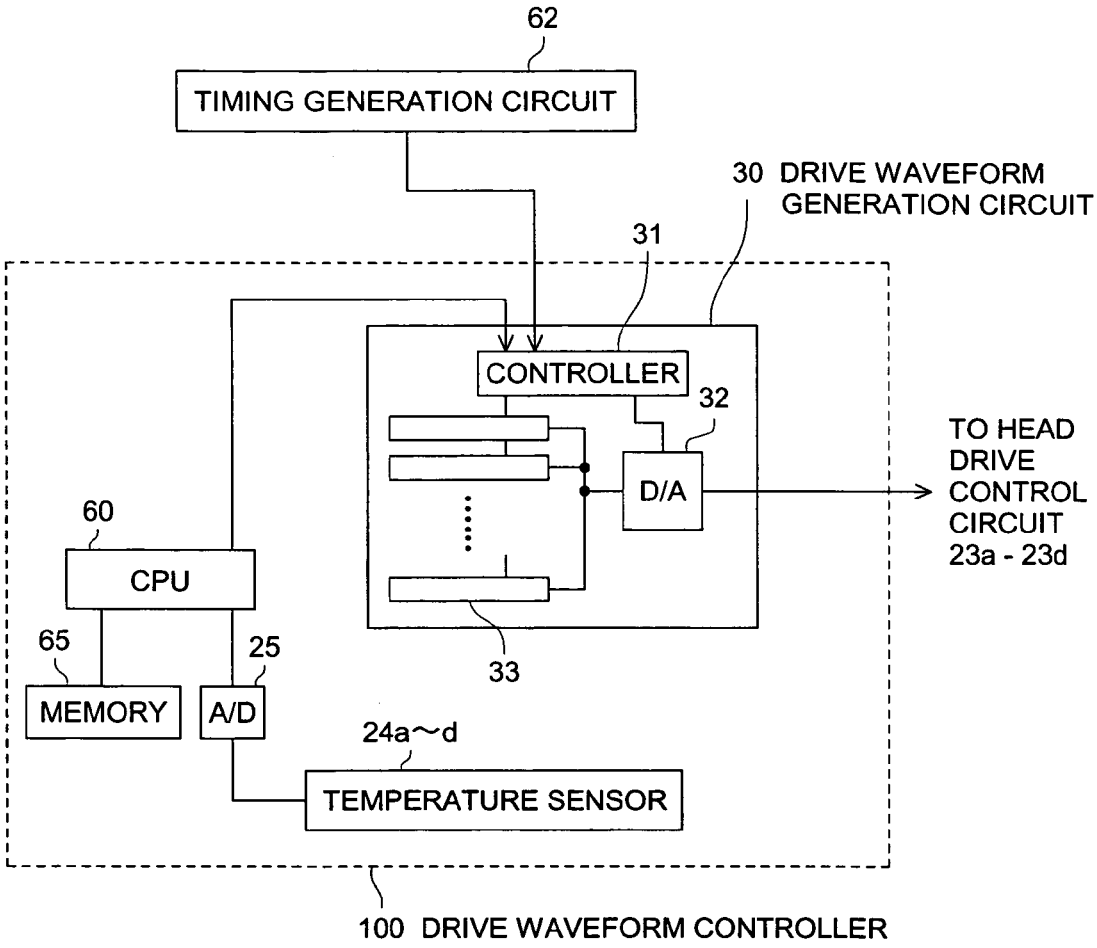
FIG. 1 is a diagram showing the electrical and entire structure of a drive waveform controller.

FIG. 1 is a diagram on which only the structure of drive waveform controller 100 related to the present embodiment alone is extracted from the aforementioned electrical structure. The drive waveform controller 100 includes CPU 60, memory 65, A/D converter 25, temperature sensors 24*a*–24*d* and drive waveform generation circuit 30. Since the CPU 60, the memory 65, the A/D converter 25 and the temperature sensors 24*a*–24*d* have already explained, an explanation for them will be omitted here, and the drive waveform generation circuit 30 will be explained below.

The drive waveform generation circuit 30 includes controller 31, D/A converter 32 and plural line memories 33. The line memory 33 is composed of SRAM and others, and drive waveforms which drive heads 21*a*–21*d* are stored in the line memory 33. In each of plural line memories 33, there are stored drive waveforms whose amplitudes are different stepwise one another by prescribed amount. The D/A converter 32 converts drive waveforms stored in the line memory 33 from digital signals to analog signals, and transmits them to head drive control circuits 23*a*–23*d*.

The controller 31 selects line memory 33 based on drive waveform selection signal coming from CPU 60, then, conducts reading of drive waveform from the line memory, and conducts D/A conversion in synchronization with latch signals of timing generation circuit 62.

FIG. 5 shows an example of a drive waveform stored in line memory 33. The drive waveform is composed of a first rectangular waveform having positive polarity and a second rectangular waveform following the first rectangular waveform. In this case, amplitude Von of the first rectangular waveform and amplitude Voff of the second rectangular waveform constantly keep a fixed ratio. Therefore, if either one of them is specified, a drive waveform can be determined uniquely. When an amplitude of the drive waveform is mentioned hereinafter, the amplitude is assumed to be either one of the first rectangular waveform and the second rectangular waveform.

Incidentally, when the aforementioned drive waveform is used, ink droplets can be ejected stably and efficiently. In particular, if a pulse width of the first rectangular waveform is established to be one half of the acoustical resonance period of the channel, droplets can be ejected by utilizing generated pressure more efficiently, which is preferable. Further, an edge of a rear end of the second rectangular waveform has a function to cancel residual pressure wave remaining in the channel after ejection of droplets, and thereby, the residual pressure wave can be properly canceled by keeping a ratio of an amplitude of the second rectangular waveform to that of the first rectangular waveform to be constant, even when voltage of the drive waveform is changed according to temperature changes.

Incidentally, the drive waveform explained here is an example, and the invention is not limited to the drive waveform of this kind. The drive waveform may be either a drive waveform composed of only the first rectangular waveform that increases a volume of an ink channel and returns it to the original volume after keeping the increased volume for a certain period of time, or a slope waveform and an optional analog waveform, without being restricted to the rectangular waveform. The drive waveform further includes a drive waveform which generates a micro-vibration of meniscus in a nozzle within the extent that droplets are not ejected from the nozzle.

In the drive waveform in the invention, it is possible either to control only an partial amplitude according to temperature changes, or to control an whole amplitude to be in the similar figure for an entire drive waveform. Incidentally, the rectangular wave mentioned here means a waveform wherein each of a rise time covering from 10% to 90% of an amplitude and a fall time covering from 90% to 10% of an amplitude is not more than one fifth, preferably one tenth of the acoustical resonance period of the channel.

Each of FIG. 6(*a*), FIG. 6(*b*) and FIGS. 7(*a*)–7(*c*) is a diagram showing an example of heads 21*a*–21*d*, and FIG. 6(*a*) is a schematic perspective view, FIG. 6(*b*) is a cross-sectional view and each of FIGS. 7(*a*)–7(*c*) is a diagram showing operations in the course of ink ejection. In FIG. 6(*a*) and FIG. 6(*b*), the numeral 121 represents an ink tube, 122 represents a nozzle forming member, 123 represents a nozzle, 124 represents a cover plate, 125 represents an ink supply port, 126 represents a base plate and 127 represents a partition wall. Channel 128 is formed by the partition wall 127, the cover plate 124 and the base plate 126.

As shown in FIGS. 7(*a*)–7(*c*), here, the heads 21*a*–21*d* are recording heads of a shear mode type which are provided with, plural channels 128 arranged between the cover plate 124 and the base board 126, between the cover plate 124 and the base plate 126, each being partitioned by plural partition walls 127A, 127B and 127C, which are made of a piezoelectric material such as PZT representing an electromechanical converter. In FIGS. 7(*a*)–7(*c*), three channels (128A, 128B and 128C) representing a part of a large number of channels 128 are shown. One end of channel 128 (which may occasionally be called as a nozzle end, hereinafter) is connected to nozzle 123 formed on nozzle forming member 122, while, the other end (which may occasionally be called as a manifold end, hereinafter) is connected with an unillustrated ink tank by the ink tube 121 through the ink supply port 125. On the surface of the partition wall 127 in each channel 128, there are closely formed electrodes 129A, 129B and 129C each being connected from the upper part of both partition walls 127 to the bottom surface of the base plate 126, and respective electrodes 129A, 129B and 129C are connected to drive waveform controller 100 through head drive control circuits 23*a*–23*d*.

Though each partition wall 127 is composed of two piezoelectric materials 127*a* and 127*b* each having a different polarization direction, as shown with arrows in FIG. 6(*b*) or in FIGS. 7(*a*)–7(*c*), the piezoelectric material may be used in only a part of the symbol 127*a*, and the piezoelectric material has only to be used on at least a part of partition wall 127.

When ejection pulses are applied on electrodes 129A, 129B and 129C which are formed closely on the surface of each partition wall 127 by the control of drive waveform controller 100, droplets are ejected from nozzle 123 by the operations exemplified below. Incidentally, nozzles are omitted in FIGS. 7(*a*)–7(*c*).

First, when none of the polarization direction is impressed with an ejection pulse, none of the electrodes 129A, 129B and 129C is deformed. However, under the condition shown in FIG. 7(*a*), when electrodes 129A and 129C are grounded and an ejection pulse is applied on the electrode 129B, there is generated an electric field that is in the direction perpendicular to the polarization direction of the piezoelectric material constituting the partition walls 127B and 127C, then, sheared deformation is caused on each of the partition walls 127B and 127C at a joint surface between the partition walls 127*a* and 127*b*, thereby the partition walls 127B and 127C are deformed outward each other, as shown in FIG. 7(*b*), to increase a volume of channel 128B and thereby to generate negative pressure in the channel 128B, thus, ink flows into the channel (Draw).

When the voltage is returned to zero under this condition, partition walls 127B and 127C return to the normal position shown in FIG. 7(*a*) from their expanded positions shown in FIG. 7(*b*), and high pressure is applied on ink in channel 128B (Release). Then, as shown in FIG. 7(*c*), when a volume of channel 128B is reduced by impressing ejection pulses so that partition walls 127B and 127C are deformed in opposite directions each other, there is generated positive pressure in channel 128B (Reinforce). Hereby, an ink meniscus in a nozzle formed by a part of ink filled in channel 128B changes the moving direction to be pushed out of the nozzle. When this positive pressure grows greater to the level to eject droplets out of the nozzle, droplets are ejected from the nozzle. The other respective channels operate equally to the foregoing when ejection pulses are applied. The ejection method of this kind is called a DRR driving method which is a typical driving method for a recording head of a shear mode type.

When driving heads 21*a*–21*d* having plural channels 128 each being partitioned by partition wall 127 at least a part of which is formed by piezoelectric materials, if a partition wall of one channel operates to eject, the adjoining channel is affected by the operation. Therefore, in general, channels 128 each being apart from others by skipping over one or more channels are collected into one group, in a plurality of channels 128, so that the plural channels 128 may be divided into two or more groups, and driven in a time sharing mode so that respective groups may conduct ink ejecting operations successively. For example, in the case of printing solid images by driving all channels 128, the so-called three-cycle ejecting method is carried out to eject cyclically by dividing all channels into three phases by selecting every third channel.

The three cycle ejecting operations will further be explained, referring to FIGS. 8(*a*)–8(*c*). In examples shown in FIGS. 8(*a*)–8(*c*), an explanation is given under the assumption that each of heads 21*a*–21*d* is composed of 9 channels including A1, B1, C1, A2, B2, C2, A3, B3 and C3. FIG. 9 shows a timing chart of a pulse waveform impressed on channel 128 of each group in A, B and C groups in the case of the foregoing.

In the case of ejecting ink, a voltage is applied first on an electrode of each channel of group A (A1, A2, A3), and electrodes of channels on both sides of the aforesaid channel are grounded. For example, if an ejection pulse representing the first rectangular wave with positive voltage having 1 AL width is applied on channel 1A of group A, a partition wall of a channel of group A to eject is deformed outward, and thereby, negative pressure is generated in that channel 128. This negative pressure causes ink to flow into the channel 128 of the group A from an ink tank (Draw). Incidentally, AL (Acoustic Length) is one half of the acoustical resonance period of the channel, as stated above.

After this condition is kept for a period of 1 AL, pressure is reversed to positive pressure, therefore, if the electrode is grounded at this timing, the deformation of the partition wall returns to the original shape, and high pressure is applied on ink in channel 128 of the group A (Release). Further, if negative voltage representing the second rectangular wave is applied on the electrode of each channel of the group A at the same timing, the partition wall is deformed inward, and thereby, the higher pressure is applied on ink (Reinforce), and ink is pushed out of a nozzle (FIG. 8(*a*)). After the lapse of time 1 AL, the pressure is reversed to cause negative pressure in the channel 128, and after another lapse of time 1 AL, pressure in the channel 128 is reversed to be positive pressure, thus, if the electrode is grounded at this timing, the deformation of the partition wall returns to its original shape, and remaining pressure wave can be canceled.

Then, the same operations are carried out for each channel 128 of group B (B1, B2, B3), and further for each channel 128 of group C (C1, C2, C3) (FIG. 8(*b*), FIG. 8(*c*)).

The deformation of the partition wall is caused by a difference between voltage applied on the electrode provided on one side of the wall and voltage applied on the electrode provided on the other side of the wall, in the inkjet recording head of a shear mode type. Therefore, it is also possible to obtain the same operations by using another method wherein the electrode of the channel conducting ink ejection is grounded, and positive voltage is applied on electrodes of channels on both sides of the aforesaid channel as shown in FIG. 10, instead of applying negative voltage on the electrode of the channel conducting ink ejection. This method is preferable because only positive voltage is used for driving.

Now, the relationship between an amplitude of the drive waveform and temperature changes will be stated, before explaining operations of drive waveform controller 100 related to the present embodiment.

Ink droplets ejected from a nozzle play an important part in determining image quality of images formed on recording medium 1. First, dispersion in volumes of droplets causes dispersion in areas of dots constituting pixels formed on recording medium 1, which results in a deterioration of image quality. Further, droplets are ejected from heads 21*a*–21*d* traveling at a certain speed in the primary scanning direction at the position that is a prescribed distance away from recording medium 1, as shown in FIG. 3(*a*). Therefore, dispersion in speeds of ejected droplets turns out to be dispersion in landing positions of droplets on recording medium 1, resulting in a deterioration of image quality.

On the other hand, a volume and speed of an ejected droplet vary depending on viscosity of ink in a channel. In this case, when an amplitude of the drive waveform is made larger, a change of channel volume become greater, and a volume and speed of a droplet to be ejected are increased. Further, when viscosity becomes higher, a volume and speed of a droplet to be ejected are decreased by flow resistance such as a fluid friction, contrary to the foregoing.

When head temperatures are changed, viscosity of ink in the head is changed, and drive sensitivity of a piezoelectric material in the head is changed in the head employing a piezoelectric element, in particular, and relationship between drive voltage and generated pressure, and between drive voltage and speed of ejected droplet as well is changed. Therefore, temperature dependency of drive voltage that makes droplet speed constant mainly includes an influence of viscosity by temperature changes and an influence of a piezoelectric element sensitivity by temperature changes.

In this case, viscosity of ink, namely, of a liquid varies depending on temperatures. This change of viscosity by temperature is approximated by the following relational expression called Andrade's expression;

$$\eta \propto \mathrm{EXP}(1/T) \quad (1)$$

wherein, η represents viscosity and T represents temperature.

In the past, it has been considered sufficient that we should take into account only correction of ink viscosity change for correction of drive voltage against temperature change. However, when drive voltage is corrected for the temperature change only by ink viscosity dependency of drive voltage, there is caused a discrepancy in droplet speeds.

On the other hand, in changes of sensitivity of a piezoelectric element by temperatures, the sensitivity becomes higher as temperature rises, but the changes are not uniform against temperature. Therefore, drive voltage that makes droplet speed constant was measured by changing head temperature, and based on these data, temperature correction value V for drive voltage was fitted to exponential function V=EXP(A/T+B) by the least square method for head temperature T (absolute temperature K; T=273+t for t° C.), thus, it was found that the drive voltage that makes droplet speed constant can be obtained accurately against a large temperature change.

Next, operations of drive waveform controller 100 will be explained as follows, referring to FIG. 11. FIG. 11 is a flow chart illustrating operations of the drive waveform controller 100. First, CPU 60 acquires temperature information from temperature sensors 24*a*–24*d* arranged in the vicinity of heads 21*a*–21*d* (step S 601). The CPU 60 refers to a correction table in memory 65 after acquiring the temperature information (step S 602). This correction table is a table showing the relationship between temperatures and amplitudes of drive waveforms, and it is one satisfying the following relational expression when T represents temperatures and V represents amplitudes;

$$V = \mathrm{EXP}(A/T+B) \quad (2)$$

wherein, A and B represent a constant determined experimentally.

After that, CPU 60 determines an amplitude from the correction table based on expression (2) (step S 603). Then, CPU 60 transmits the determined amplitude information to controller 31 of drive waveform generation circuit 3.

After that, the controller 31 selects a drive waveform of which amplitude agrees from plural line memories 33 based on the amplitude information (step S 604). Then, the controller 31 conducts A/D conversion, in synchronization with latch signals coming from timing generation circuit 62, and outputs analog drive waveform to head drive controlling circuits 23*a*–23*d*.

FIG. 12 shows examples of a function form which is read in the correction table determined based on expression (2), including actual measured values of drive voltage with which droplet speeds become 6 m/s in the case of changing temperatures on shear mode type heads shown in FIGS. 7(*a*)–7(*c*). The horizontal axis represents head temperatures, and the vertical axis represents drive voltage. It is understood that the actual measured values can be reproduced accurately by the use of the foregoing function form. In FIG. 12, an amplitude of the drive waveform is made smaller on an exponential function basis as temperature rises, and increases in volume and speed of an ejected droplet resulting from a decline of ink viscosity according to the temperature rise are corrected in a broad temperature range.

FIG. 13 shows relationship between ink viscosity and temperature for the ink with which the correction table in FIG. 12 is obtained. There is a difference between the curvature of a temperature correction curve for drive voltage in FIG. 12 and the curvature of a temperature-dependency curve for viscosity in FIG. 13, and a temperature correction curve for drive voltage includes an influence of a factor other than ink viscosity. Nevertheless, it is understood that excellent approximating is achieved by the function form of expression (2).

Incidentally, when determining constant A and constant B experimentally, it is possible to determine so that speed of a droplet ejected from a nozzle may not be changed by temperature changes, or to determine so that a volume of a droplet ejected from a nozzle may not be changed by temperature changes. In general, for avoiding that an landing position of a droplet ejected from a nozzle on recording medium1 1 is changed, the constant is determined in a way that speed of an ejected droplet is not be changed by temperature change. However, when ink viscosity is high and temperature change is large, a change in a volume of a droplet takes place even when speed of a droplet is kept to be constant by correcting an amplitude. In this case, when the density of a pixel formed on recording medium 1 is considered more important, it is also possible to correct an amplitude so that a volume of a droplet may be constant. Further, a function form of the correction table can be obtained by a function fitting wherein the least square method is used to experimental data.

Further, regarding the viscosity of ink to be used, in the case of ink is high viscosity ink having a temperature point at which the viscosity exceeds 10 mPa·s (milli-pascal second) in a working temperature range of inkjet recording apparatus 10, for example, in a range of 5° C.–35° C., the invention exhibits its remarkable effect. When ink viscosity is high, a change of viscosity caused by temperature changes is great, and non-linearity of drive voltage changes by temperatures turns out to be great, resulting in effective temperature correction by a function form in the invention.

In the case of ink with low viscosity wherein its viscosity does not exceed 10 mPa·s in a working temperature range, a change rate of the viscosity by temperatures is less than 0.3 mPa·s/° C., and therefore, the drive voltage change by temperatures is also small. Even in this case, although a correction table employing conventional linear approximation can also make the correction discrepancy of drive voltage to be small, it is possible to conduct temperature correction more accurately, by using the correction table of a function form of the invention. In the case of high viscosity ink wherein viscosity rises to exceed 30 mPa·s in a working temperature range of a head, on the other hand, it is not possible to use, because ink ejection in the head becomes impossible.

Further, when a width of a range of working temperatures used in inkjet recording apparatus 10 is not less than 20° C., the invention shows its effect that is conspicuous. If the temperature range is broad, an amount of changes of drive voltage is large, and non-linearity of drive voltage changes against temperatures also becomes greater, resulting in effective temperature correction by the function form in the invention.

Further, when a range of working temperatures in the head is less than 20° C., non-linearity of drive voltage changes by temperatures is small, and even in this case, although a correction table employing conventional linear approximation can also make the correction discrepancy of drive voltage to be small, it is possible to conduct temperature correction more accurately, by using the correction table of a function form of the invention.

As stated above, in the present embodiment, expression (2) is established in the correction table of memory 65, and from the temperatures detected by temperature sensors 24*a*–24*d*, CPU 60 uses this correction table to determine an amplitude of drive waveform of a piezo-head, and thereby to correct changes in speed and a volume of a droplet caused by temperature changes in the head. It is therefore possible to prevent changes in landing positions of droplets or in pixel density for a broad temperature range, and thereby to conduct forming of images with high image quality.

Though in this embodiment an amplitude of a drive waveform for driving heads 21*a*–21*d* is determined by one correction table expressed by expression (2), it is also possible to provide correction tables each is different for each of heads 21*a*–21*d* using respectively different colors of ink, and thereby to establish an amplitude of a drive waveform for each of heads 21*a*–21*d*.

As is understood from the explanation stated above, the objects of the invention are achieved by the inkjet recording apparatuses described below.

(1) An inkjet recording apparatus having therein a head ejecting ink droplets, a temperature detector that detects temperatures in the vicinity of the head, and a drive waveform controller that generates a drive waveform that drives the head, wherein the drive waveform controller changes the amplitude as the temperature changes based on temperature information coming from the temperature detector, following the expression V=EXP(A/T+B) wherein V represents an amplitude of the drive waveform, T represents the temperature and A and B represent a constant.

In the structure described in item (1), the drive waveform controller changes the amplitude of the drive waveform according to the temperature changes, following the expression V=EXP(A/T+B) wherein V represents an amplitude of the drive waveform, T represents temperature and A and B represent a constant.

(2) An inkjet recording apparatus wherein the drive waveform has the first rectangular wave that increases a volume of an ink channel that reserves ink, then keeps the increased volume for a certain period of time, and returns it to the original volume, and the second rectangular wave that follows the first rectangular wave, and decreases a volume of the ink channel, then keeps the decreased volume for a certain period of time, and returns it to the original volume, and a ratio of the amplitude of the first rectangular wave to the amplitude of the second rectangular wave is made to be constant.

In the structure described in item (2), a ratio of the amplitude of the first rectangular wave to the amplitude of the second rectangular wave is made to be constant, in the drive waveform.

(3) An inkjet recording apparatus wherein viscosity of the ink exceeds 10 mPa·s at a temperature within a range of working temperatures of the inkjet recording apparatus.

In the invention described in item (3), ink viscosity exceeds 10 mPa·s within a range of working temperatures.

(4) An inkjet recording apparatus wherein a width of a range of working temperatures is 20° C. or more in the inkjet recording apparatus.

In the structure described in item (4), the inkjet recording apparatus is used within a wide range of working temperatures of 20° or more.

(5) An inkjet recording apparatus wherein the drive waveform controller changes the amplitude so that a speed of the ejected droplet is kept constant.

In the structure described in item (5), a speed of the ejected droplet is made to be constant for temperature changes.

(6) An inkjet recording apparatus wherein the drive waveform controller changes the amplitude so that a volume of the droplet is kept constant.

In the structure described in item (6), a volume of a droplet is made to be constant for temperature changes.

(7) An inkjet recording apparatus wherein the temperature detector is provided on each of the heads, which are installed in the inkjet recording apparatus.

In the structure described in item (7), the temperature detector is provided on each of the heads, which are installed in the inkjet recording apparatus.

(8) An inkjet recording apparatus wherein the drive waveform controller has a memory in which a correction table expressing the aforesaid expression is stored, and the amplitude for the temperature mentioned above is obtained by referring to the correction table.

In the structure described in item (8), the drive waveform controller obtains an amplitude for the temperature by referring to the correction table.

(9) An inkjet recording apparatus wherein the drive waveform controller is provided with the correction table for each type of ink, when the ink is composed of plural different types of ink and each type of ink has the plural heads.

In the structure described in item (9), the drive waveform controller is provided with correction tables for each different type of ink.

(10) An inkjet recording apparatus wherein the head is provided with an electromechanical converter wherein a volume of the ink channel is changed by application of the drive waveform to eject ink droplets.

In the structure described in item (10), the head changes a volume of an ink channel when a drive waveform is applied on an electromechanical converter, and ejects ink droplets.

(11) An inkjet recording apparatus, wherein the electromechanical converter comprises a piezoelectric member, which forms a partition wall between adjoining ink channels, the piezoelectric member being deformed on a shearing mode with a voltage application.

In the structure described in item (11), the electromechanical converter forms a partition wall between adjoining ink channels with piezoelectric members and deforms the partition wall on a shearing mode basis by applying voltage.

As explained above, in the structure described in item (1), the drive waveform controller changes an amplitude of the drive waveform when temperatures change, following the expression V=EXP(A/T+B) wherein V represents an amplitude of the drive waveform, T represents the temperature and A and B represent a constant. Therefore, even when using ink with high viscosity, it is possible to make a speed or a volume of ejected droplets to be constant within a broad range of temperature changes, and to prevent deterioration of image quality by making an landing position or an area of droplet on a recording medium to be constant.

In the structure described in item (2), a ratio of the amplitude of the first rectangular wave to the amplitude of the second rectangular wave is made to be constant, in the drive waveform, and therefore, and even when the amplitude of the drive waveform is changed, a residual pressure wave caused by introduction of ink into an ink channel of the head or by ejection and driving can be canceled under the optimum condition.

In the structure described in item (3), ink viscosity exceeds 10 mPa·s within a range of working temperatures, which makes correction of an amplitude for temperature changes to be effective.

In the structure described in item (4), the inkjet recording apparatus is to be used within a range of working temperatures of 20° or more, which makes correction of the amplitude for broad temperature changes to be accurate.

In the structure described in item (5), a speed of the ejected droplet is made to be constant for temperature changes, which makes the landing position of a droplet to be constant.

In the structure described in item (6), a volume of a droplet is made to be constant for temperature changes, which makes density of a pixel to be stable.

In the structure described in item (7), the temperature detector is provided on each of the heads which are installed in the inkjet recording apparatus, which makes it possible to detect temperature changes for each head, and to conduct accurate correction of temperature for each head.

In the structure described in Structure (8), the drive waveform controller obtains an amplitude for the temperature by referring to the correction table, which makes it possible to conduct accurate temperature correction by the simple structure.

In the structure described in item (9), the drive waveform controller is provided with correction tables for each different type of ink, which makes it possible to conduct accurate temperature correction even in the case where a characteristic of ink viscosity for temperature changes is different for each type of ink.

In the structure described in item (10), the head changes a volume of an ink channel when a drive waveform is applied on an electromechanical converter, and ejects ink droplets, which makes it possible to control droplets accurately.

In the structure described in item (11), the electromechanical converter forms a partition wall between adjoining ink channels with piezoelectric materials and deforms the partition wall on a shearing mode basis by applying voltage, which makes it possible to eject ink in the ink channel by subdividing the ink into a droplet in a prescribed volume.

What is claimed is:

1. An inkjet recording apparatus comprising:

a head for ejecting a droplet of ink;

a temperature sensor for detecting a temperature in a vicinity of the head; and a drive waveform controller for generating a drive waveform that drives the head, wherein the drive waveform controller changes an amplitude of the drive waveform based on temperature information coming from the temperature sensor, according to an expression of V=EXP(A/T+B), where V represents an amplitude of the drive waveform, T represents the temperature and each of A and B represents a constant.

2. The inkjet recording apparatus of claim 1, wherein the drive waveform comprises a first rectangular wave that increases a volume of an ink channel reserving the ink, then keeps the volume increased for a certain period of time and returns it to an original volume; and a second rectangular wave that follows the first rectangular wave, and decreases the volume of the ink channel, then keeps the volume decreased for a certain period of time, and returns it to the original volume, wherein a ratio of an amplitude of the first rectangular wave to an amplitude of the second rectangular wave is made to be constant.

3. The inkjet recording apparatus of claim 1, wherein viscosity of the ink exceeds 10 mPa·s at a temperature within a range of working temperatures of the inkjet recording apparatus.

4. The inkjet recording apparatus of claim 1, wherein a width of a range of working temperatures of the inkjet recording apparatus is 20° C. or more.

5. The inkjet recording apparatus of claim 1, wherein the drive waveform controller changes the amplitude of the drive waveform so that a speed of the ejected droplet of ink is kept constant.

6. The inkjet recording apparatus of claim 1, wherein the drive waveform controller changes the amplitude of the drive waveform so that a volume of the droplet of ink is kept constant.

7. The inkjet recording apparatus of claim 1, comprising plural heads for ejecting droplets of ink, wherein each of the plural heads is provided with the temperature sensor.

8. The inkjet recording apparatus of claim 1, wherein the drive waveform controller has a memory in which a correction table satisfying the expression is stored, and the drive waveform controller obtains the amplitude of the waveform for the temperature by referring to the correction table.

9. The inkjet recording apparatus of claim 8, wherein the ink comprises plural different types of ink, and the inkjet recording apparatus comprises plural heads, each of the plural heads being provided for each of the plural different types of ink, wherein the drive waveform controller comprises the correction table for each type of ink.

10. An inkjet recording apparatus of claim 1, wherein the head comprises an electromechanical converter for changing a volume of the ink channel by application of the drive waveform to eject droplets of ink.

11. An inkjet recording apparatus of claim 10, wherein the electromechanical converter comprises a piezoelectric member which forms a partition wall between adjoining ink channels, the piezoelectric member being deformed on a shearing mode with a voltage application.

12. A control method of an inkjet recording apparatus, for driving a head for ink droplet ejection with a drive waveform, the control method comprising:

detecting a temperature in a vicinity of the head; and changing an amplitude of the drive waveform based on temperature information coming from the temperature sensor, according to an expression of V=EXP(A/T+B), where V represents an amplitude of the drive waveform, T represents the temperature and each of A and B represents a constant.

13. The control method of claim 12, wherein the drive waveform comprises a first rectangular wave that increases a volume of an ink channel reserving the ink, then keeps the volume increased for a certain period of time and returns it to an original volume; and a second rectangular wave that follows the first rectangular wave, and decreases the volume of the ink channel, then keeps the volume decreased for a certain period of time, and returns it to the original volume, wherein a ratio of an amplitude of the first rectangular wave to an amplitude of the second rectangular wave is made to be constant.

14. The control method of claim 12, wherein viscosity of the ink exceeds 10 mPa·s at a temperature within a range of working temperatures of the inkjet recording apparatus.

15. The control method of claim 12, wherein a width of a range of working temperatures the inkjet recording apparatus is 20° C. or more.

* * * * *